US008690715B2

(12) United States Patent
Vogt

(10) Patent No.: US 8,690,715 B2
(45) Date of Patent: Apr. 8, 2014

(54) LIGHT SOURCE PROJECTING LINES DEFINING ACTIVITY AREA

(76) Inventor: Steven D. Vogt, Mendon, NY (US)

( * ) Notice: Subject to any disclaimer, the term of this patent is extended or adjusted under 35 U.S.C. 154(b) by 212 days.

(21) Appl. No.: 13/222,271

(22) Filed: Aug. 31, 2011

(65) Prior Publication Data

US 2012/0065006 A1 Mar. 15, 2012

Related U.S. Application Data

(60) Provisional application No. 61/382,186, filed on Sep. 13, 2010.

(51) Int. Cl.
*A63B 61/00* (2006.01)
*G01C 15/00* (2006.01)

(52) U.S. Cl.
USPC ..... 473/490; 473/416; 33/289

(58) Field of Classification Search
USPC ..... 473/490, 416; 340/323 R; 33/289, 290
See application file for complete search history.

(56) References Cited

U.S. PATENT DOCUMENTS

| | | | | |
|---|---|---|---|---|
| 2,587,855 | A * | 3/1952 | Johnson | 62/66 |
| 2,757,570 | A * | 8/1956 | Molnar | 353/2 |
| 2,805,861 | A * | 9/1957 | Lopas | 473/472 |
| 4,832,331 | A | 5/1989 | Brandli | |
| 5,124,899 | A * | 6/1992 | Hale | 362/253 |
| 5,174,571 | A * | 12/1992 | Aubusson et al. | 473/416 |
| 7,244,046 | B2 * | 7/2007 | Webb | 362/253 |
| 2007/0053201 | A1 | 3/2007 | Dietz et al. | |
| 2007/0225092 | A1 | 9/2007 | Watson | |
| 2008/0254920 | A1 * | 10/2008 | Oresky | 473/490 |
| 2009/0195753 | A1 * | 8/2009 | Dill et al. | 353/28 |
| 2009/0197710 | A1 * | 8/2009 | Ronda | 473/490 |
| 2010/0105503 | A1 * | 4/2010 | Daisher et al. | 473/467 |
| 2012/0065006 | A1 * | 3/2012 | Vogt | 473/490 |
| 2012/0327378 | A1 * | 12/2012 | Harvey et al. | 353/52 |

FOREIGN PATENT DOCUMENTS

DE 3117183 11/1982

OTHER PUBLICATIONS

Webpage download, lightblueoptics, Jan. 2010, web.archive.org/web/20100114102840/http://lightblueoptics.com/products/light-touch/, 4 pages.*

Webpage download, xindongroup, 2008, www.xindongroup.com/technical-qz1.html, 2 pages.*

* cited by examiner

*Primary Examiner* — Gene Kim
*Assistant Examiner* — M Chambers
(74) *Attorney, Agent, or Firm* — Gibb & Riley, LLC

(57) ABSTRACT

A lighting system, for use in combination with a basketball backboard device mounted on a pole, comprises a plurality of lighting devices positioned adjacent the basketball backboard device. The lighting devices comprise a housing, a connector, a first light source, a lens and a light filter, and a secondary light source. The lens focuses lines defined by the light filter. The first light source is positioned to project the lines on to an activity surface to define a foul lane for a basketball court. The connector connects the housing to the pole supporting the basketball backboard device. The secondary light source is positioned to simultaneously illuminate a backboard of the basketball backboard device while the first light source projects the lines through the lens and the light filter. The lines from the first light source combine together on the activity surface to define an area for a basketball game.

4 Claims, 8 Drawing Sheets

LIGHT SOURCE PROJECTING LINES DEFINING ACTIVITY AREA

BACKGROUND

Embodiments herein generally relate to a lighting apparatus, and more particularly to an apparatus that projects lines on surfaces that define the area in which an activity (such as a game) occurs.

Many activities, such as games, contests, etc., are performed in areas that have boundaries and other specially designated areas or regions. For example, a basketball court, a football field, a soccer field, and a tennis court all have end lines, sidelines, and other markings that define the limits of the playing area and also define certain regions in which specific portions of the activity take place. Thus, a tennis court includes a service area defined by rectangles where a tennis ball served by a player must land. Similarly, a soccer field includes the goalie box and a penalty area defined by rectangles. Also, a basketball court includes a foul lane, a key, etc., and a football field includes end zones and yardage markers.

Normally, the markings defining such activity areas are permanently applied to the activity surface (floor, grass field, clay-court, etc.) by being painted on the activity surface or by applying contrasting materials on the activity surface to allow the lines to be visually distinguishable. However, this process of permanently applying the various lines that define the areas or regions of an activity is expensive and changes the permanent appearance of the activity surface. Additionally, on surfaces that grow or change (grass field) the markings need to be continually reapplied as the markings fade (or are removed from) the activity surface.

SUMMARY

In view of the foregoing issues, the embodiments herein provide an apparatus that can temporarily provide the lines and other markings associated with an activity or game in an easy, non-permanent, and inexpensive manner. One exemplary embodiment herein comprises an apparatus that has a housing, and a connector and a light source connected to the housing. The light source projects lines that define the boundary area for the activity, such as playing a game. The connector connects the housing to a structure used in the activity or game.

The apparatus can include a lens and a light filter that are operatively connected to (directly or indirectly connected to) the housing. The lens focuses the lines defined by the light filter on a surface where the activity or game occurs. The lines define areas where specific portions of the activity or game are to occur. The light source projects the lines on a surface that is otherwise without such lines used in the activity or game, such as a uniformly colored, non-lined area of flooring, asphalt, grass, or ground. This allows the activity or game to be played at night in an area that is not pre-lined for such an activity, without permanently altering the appearance of the surface.

The apparatus can include a self-contained power source positioned within the housing or a power unit connected to an external power source. The self-contained power source or the power unit are operatively connected to the light source and power the light source.

One specific exemplary embodiment herein is an apparatus that has a housing, a connector connected to the housing and a light source connected to the housing. The light source projects lines defining a foul lane (boundary area) for a basketball court and the connector connects the housing to a basketball backboard device, such as the pole supporting the backboard, the frame supporting the backboard, or the backboard itself. Again, the light source projects the lines on a surface that is otherwise without the usual lines that are used in a basketball game.

Such an apparatus can include a secondary light outlet on the housing. The secondary light outlet can simultaneously illuminate the backboard of the basketball backboard device while the light source projects the lines defining the foul lane for the basketball court.

Additional embodiments herein include a system that uses a plurality of such lighting devices positioned adjacent the activity surface. Each of the lighting devices again has a housing, and a light source connected to the housing. The light source projects lines onto the activity surface, and the lines from each of the lighting devices combine together on the activity surface to define the area for an activity. Again, the light sources project the lines on a portion of the activity surface that is otherwise without the lines used in the activity.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, the process of permanently applying various lines that define the areas or regions of an activity is expensive and changes the permanent appearance of the activity surface. Additionally, on surfaces that grow or change (grass field) the markings need to be continually reapplied as the markings fade (or are removed from) the activity surface. Therefore, the embodiments herein provide an apparatus that can temporarily provide the lines and other markings associated with an activity or game in an easy, non-permanent, and inexpensive manner.

Figure 1:
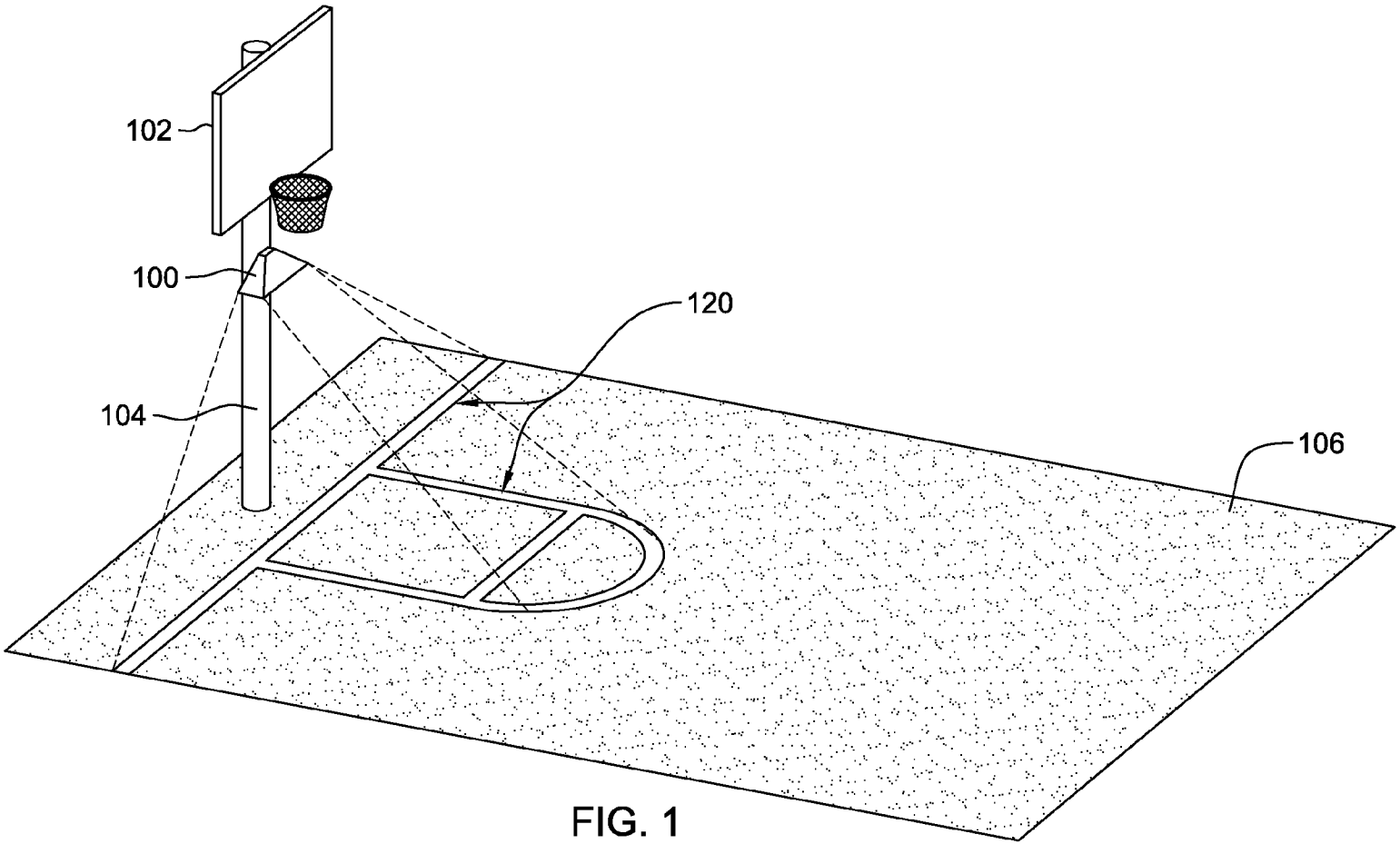
FIG. 1 is a perspective-view schematic diagram of a device according to embodiments herein.

As shown in FIG. 1, an exemplary embodiment herein is an apparatus 100 having a light source that projects lines 110 defining a foul lane and end line for a basketball court. Dashed lines in the drawings show the approximate light area broadcast by the apparatus. A connector of the apparatus 100 connects the apparatus 100 to a basketball backboard device such as the pole 104 supporting the basketball backboard 102, the frame supporting the backboard 102, or the backboard 102 itself.

The light source projects the lines 110 on a surface 106 that is otherwise without the usual lines that are used in a basketball game. For example, the surface 106 can be an asphalt, brick, grass, or concrete surface (parking lot, street, patio, etc.) or an indoor flooring surface (concrete, carpet, wood, etc.) that does not include basketball court boundary markings. The surface 106 may include other markings, such as parking lot striping, street striping, tennis court markings, etc., but may lack basketball court markings. The embodiments herein allow such basketball court markings to be temporarily provided through the light projected lines 110, avoiding the cost and visual alteration of permanently painted or applied basketball court markings.

Figure 2:
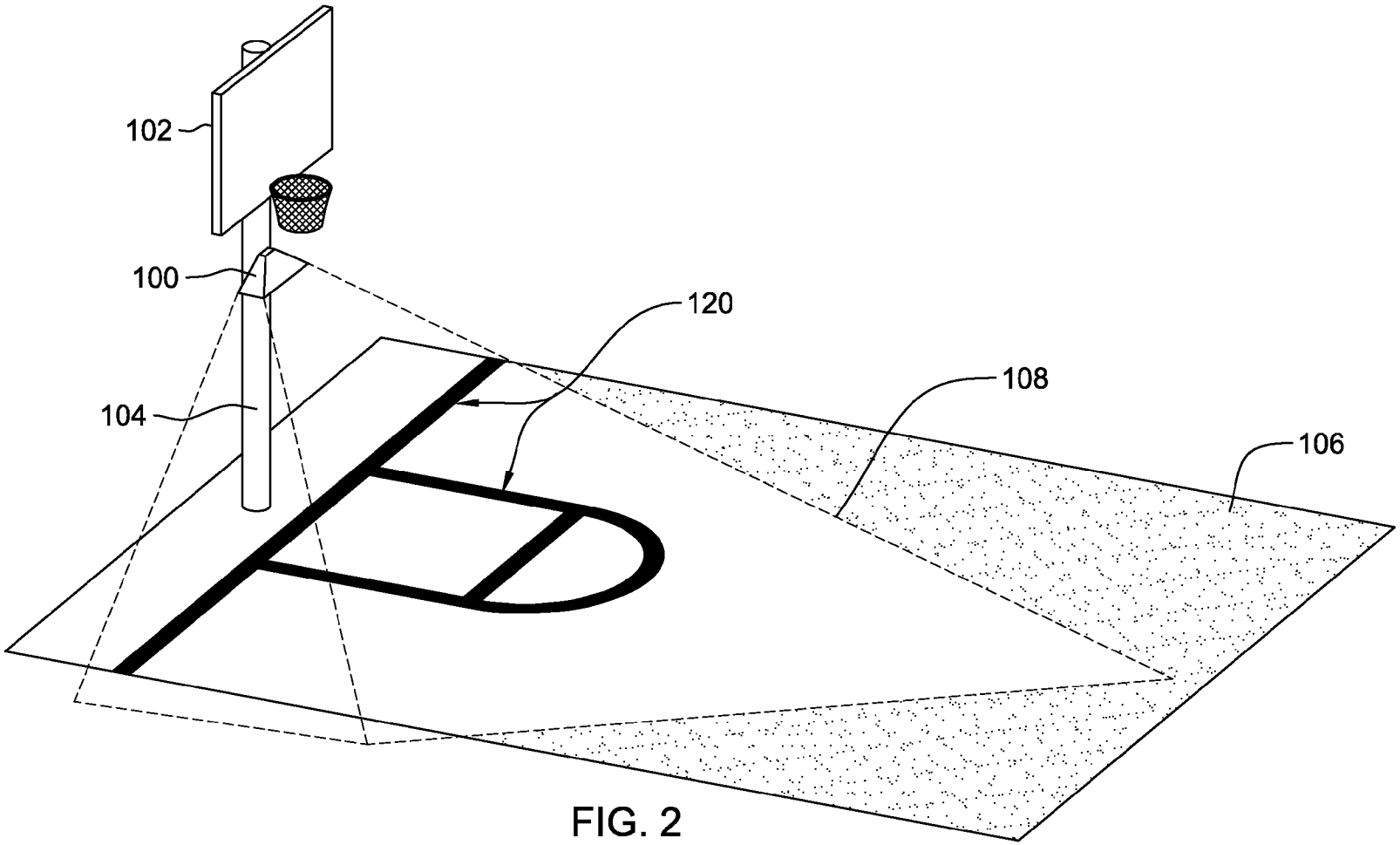
FIG. 2 is a perspective-view schematic diagram of a device according to embodiments herein.

The lines 110 can be made visual in a dark or lighted environment. For example, the light lines 110 (e.g., white, yellow, orange, pink, etc.) can be projected on a dark surface 106 (e.g., asphalt, ground, dark concrete, etc.) or can be projected on any surface 106 in a dark environment, such as a dark interior space or outdoors at night. Alternatively, as shown in FIG. 2, dark lines 120 can be projected onto a light surface 106 (e.g., white, yellow, orange, pink, etc.) or onto a surface in a lighted area (lighted indoor room or outdoors during daylight). Alternatively, the embodiments herein can illuminate a certain region (e.g., shown as item 108 in FIG. 2) with a light color, while simultaneously illuminating contrasting dark colored lines 120.

Figure 3:
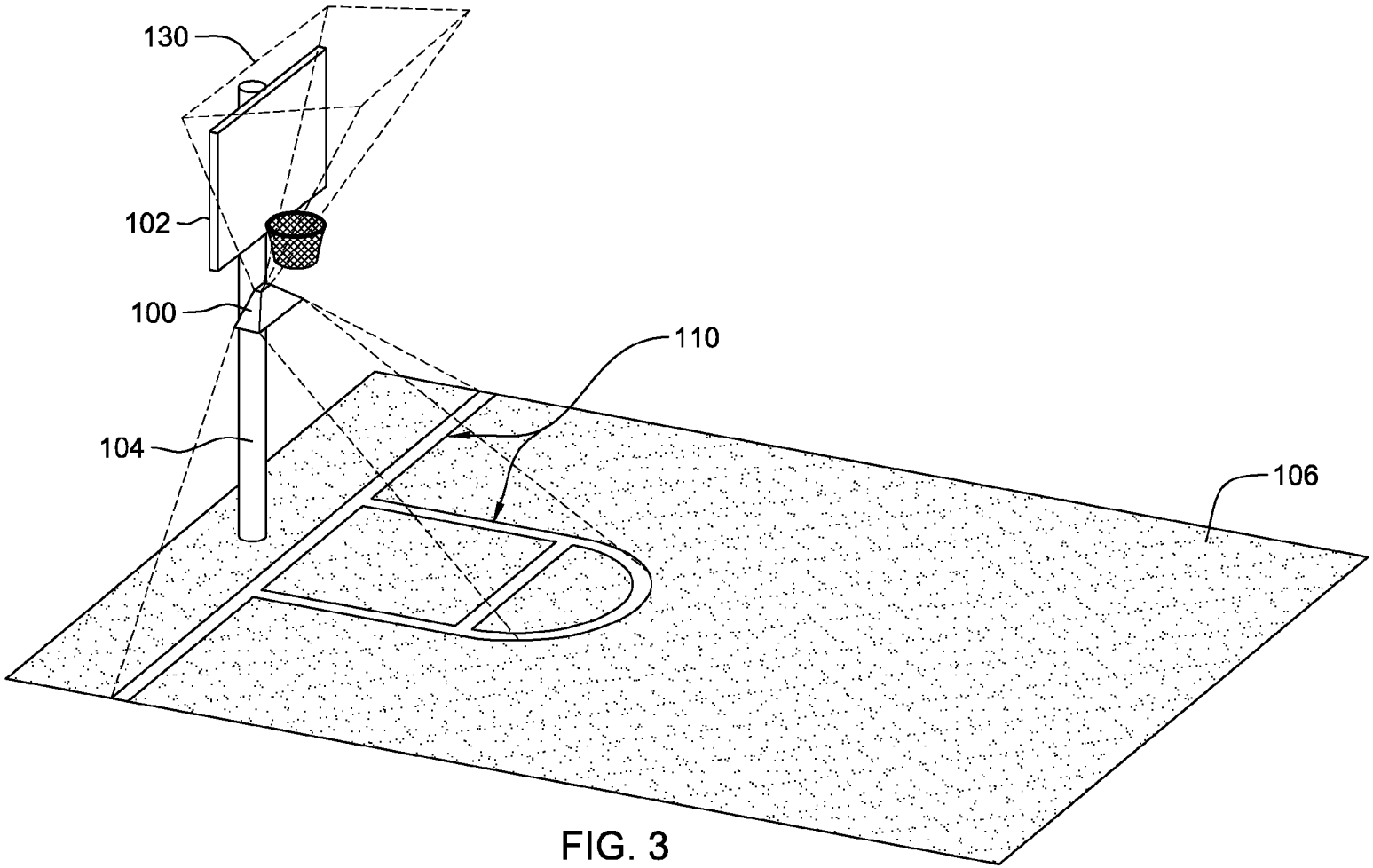
FIG. 3 is a perspective-view schematic diagram of a device according to embodiments herein.

Such an apparatus 100 can include a secondary light outlet on the housing, as shown in FIG. 3. The secondary light outlet can simultaneously provide light to an area, such as area 130, to illuminate the backboard 102 of the basketball backboard device while the light source simultaneously projects the lines 110 defining the foul lane and end line for the basketball court.

Therefore, the embodiments herein can be used in any environment and provide a way to temporarily define an activity area (such as the basketball court example shown in FIGS. 1-3) through illumination of lines 110/120 on a surface 106. While various surfaces and colors have been mentioned above, those ordinarily skilled in the art would understand that the embodiments herein are not limited to the specific examples mentioned herein. Instead, the embodiments herein are applicable to all contrasting colors and illumination conditions, all activities, all surfaces, and all environments. Thus, additional lines of the basketball court (such as the sidelines, mid-court lines, etc.) could be illuminated by embodiments herein. Additionally, for example, as shown in FIGS. 4 and 5, the embodiments herein are equally applicable to other activities, such as volleyball, tennis, football, soccer, baseball, playground squares, etc.

Figure 4:
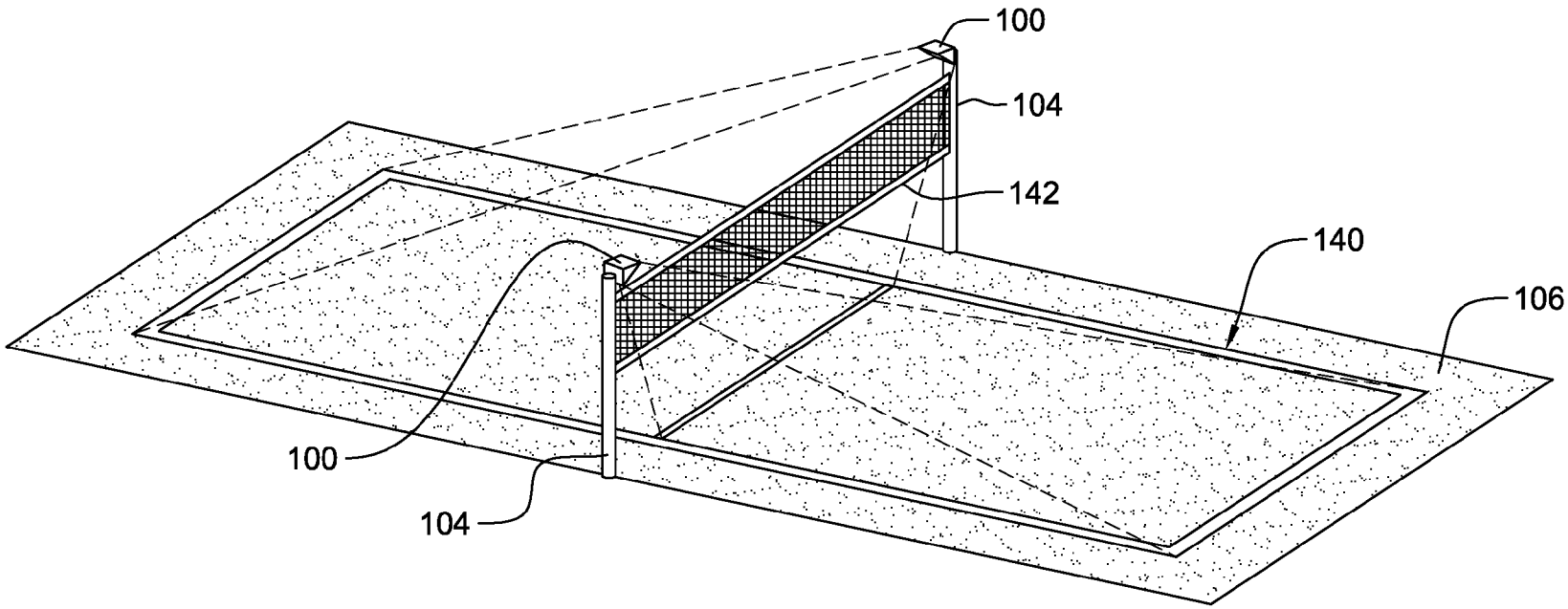
FIG. 4 is a perspective-view schematic diagram of a device according to embodiments herein.
Figure 5:
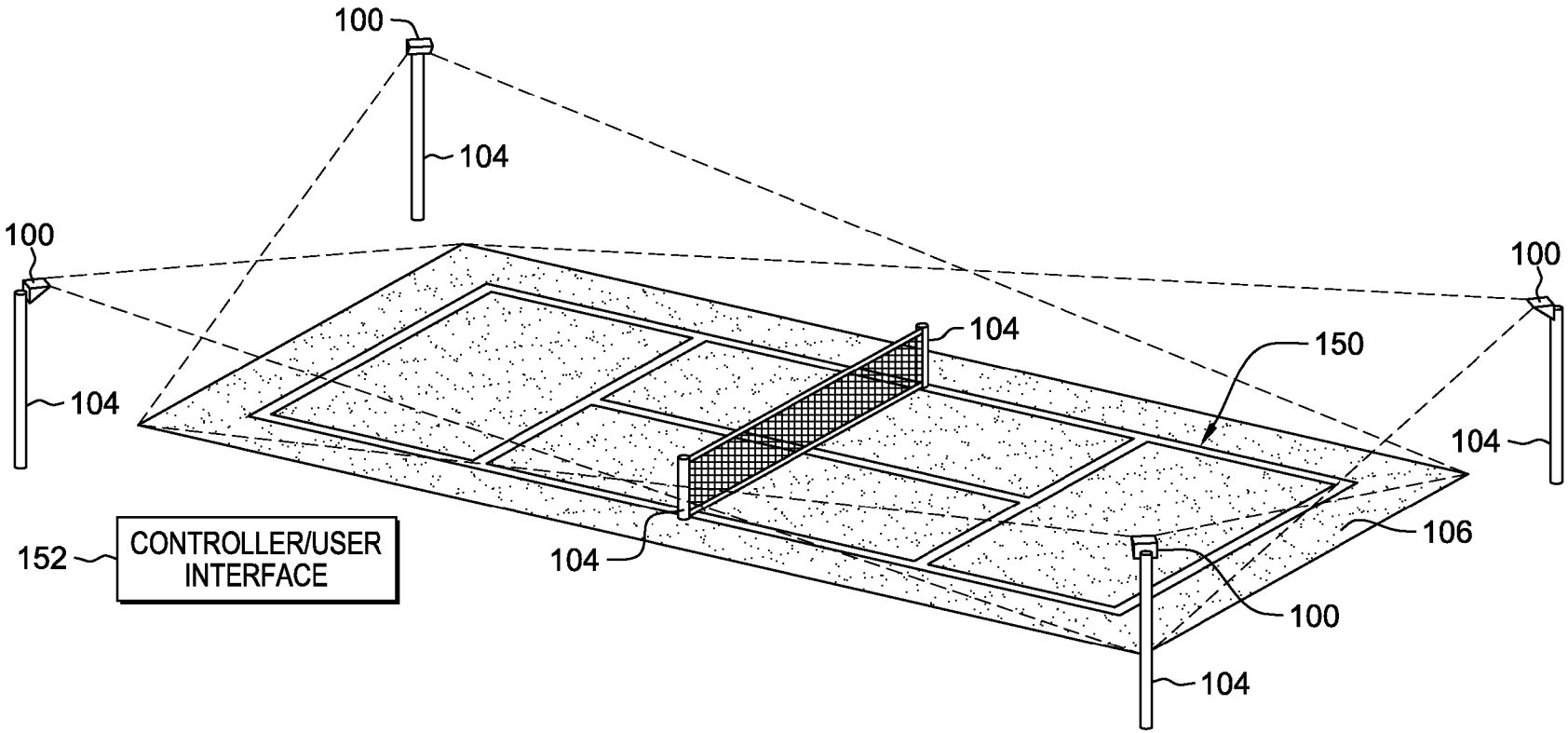
FIG. 5 is a perspective-view schematic diagram of a device according to embodiments herein.

More specifically, as illustrated in FIGS. 4 and 5, embodiments herein include a system that uses a plurality of such lighting devices 100 positioned adjacent the activity surface (e.g., mounted on the poles 104 used by the activity or positioned adjacent to the activity area). Each of the lighting devices 100 again has a housing, and a light source connected to the housing. The light source projects lines 140/150 on to the activity surface 106, and the lines from each of the lighting devices 100 combine together on the activity surface 106 to define the area for an activity. Again, the light sources project the lines on a portion of the activity surface that is otherwise without the lines or markings at all, or is at least without lines used in the activity.

Figure 6:
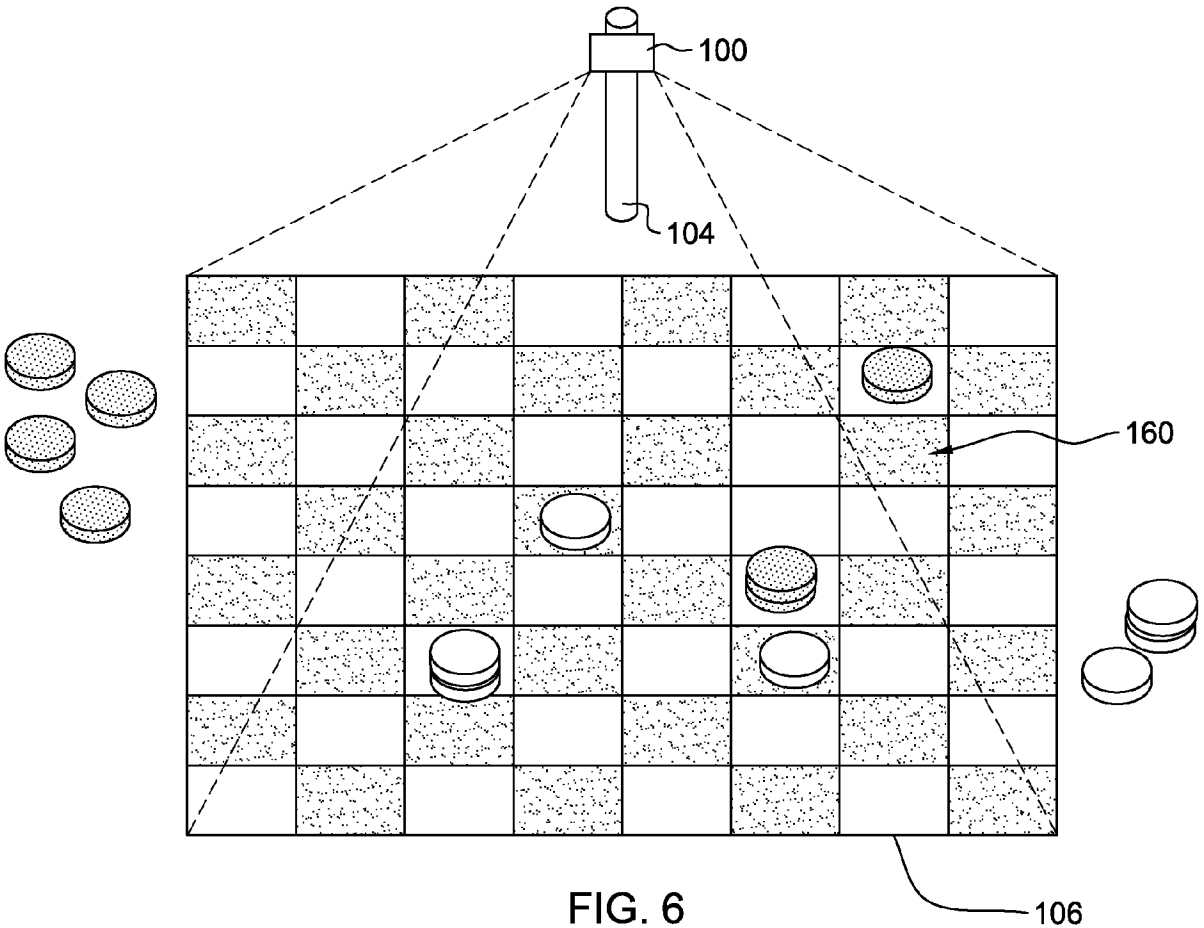
FIG. 6 is a perspective-view schematic diagram of a device according to embodiments herein.

In FIG. 4 the activity is a volleyball game, and in FIG. 5 the activity is a tennis game. However, as would be understood by those ordinarily skilled in the art, the activity can be any activity that benefits from areas being defined. Thus, a temporary game board 160 e.g., checkers, chess, backgammon, etc., can be illuminated on a blank surface 106 by the embodiments here, as shown in FIG. 6. Also, the embodiments can use multiple light sources to illuminate large areas to define a soccer field, football field, walking area, running area, exercise areas, battle areas, playground areas, etc., without requiring permanent markings to be painted or applied. When using multiple light sources, each of the lines can be eliminated by at least two different light sources located in different locations, preventing shadows from blocking the lines.

Further, with embodiments herein a single surface 106 can be quickly reconfigured from one activity (e.g., volleyball in FIG. 4, soccer, cricket, etc.) to a different activity (e.g., tennis in FIG. 5, football, baseball, etc.) simply by providing different lighting lines (140 vs. 150) and by changing any physical structures, such as the net configuration in FIGS. 4 and 5. Such changes between different activities can be controlled by a controller 152 connected (wired or wirelessly) to each of the lighting units 100. The controller 152 can include a processor, power supply, and computer-readable memory necessary to cause each of the lighting devices 100 to provide the correct pattern of illumination needed for the boundary lines associated with each of the different activities.

Figure 7:
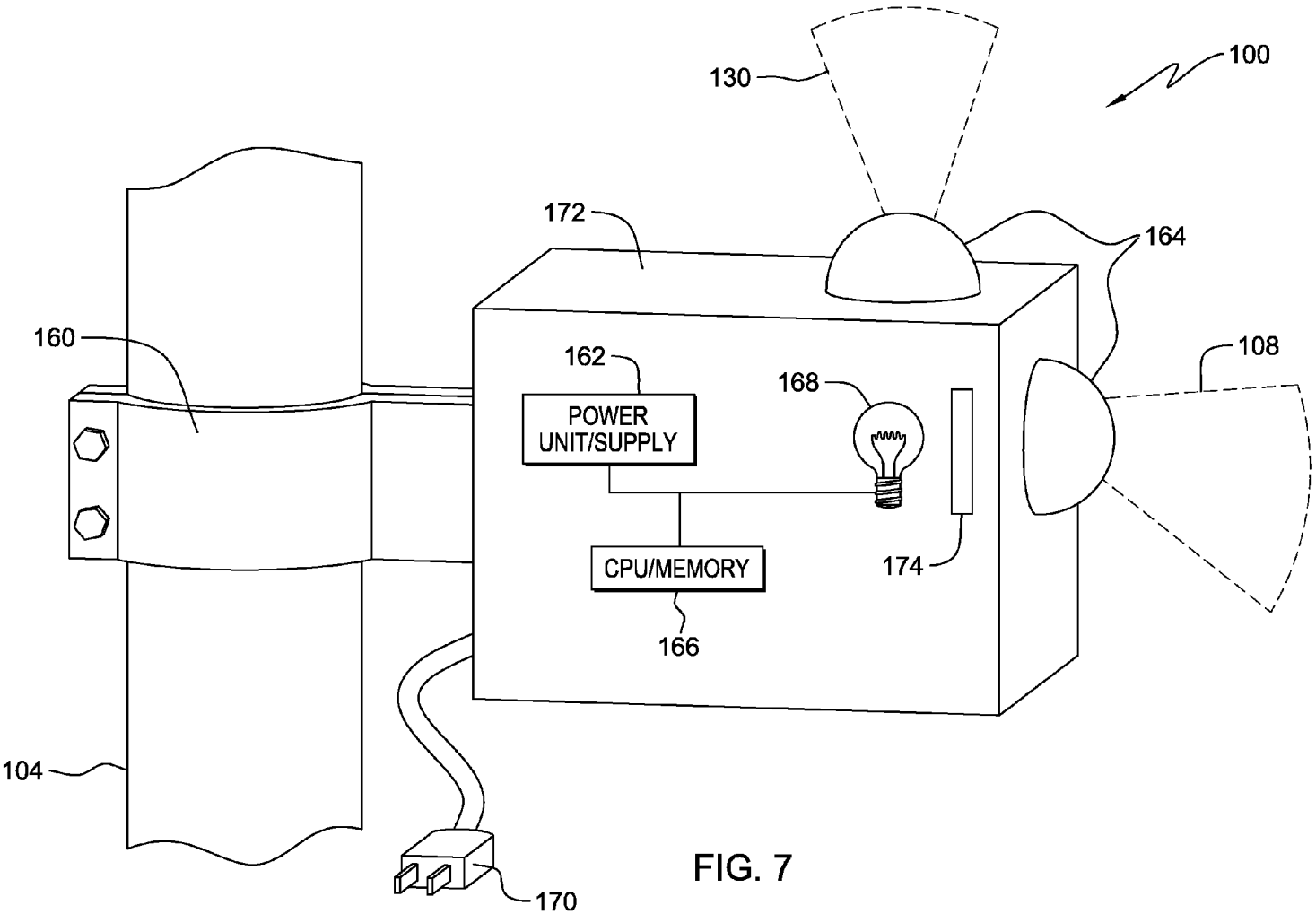
FIG. 7 is a side-view schematic diagram of a device according to embodiments herein.

FIG. 7 shows one example of the apparatus 100 in greater detail. Those ordinarily skilled in the art would understand that FIG. 7 is only one example and that the embodiments herein could take on many different configurations. As shown in FIG. 7, the lighting apparatus 100 includes a housing 172, a connector 160, a light source 168, and an optional light filter 174 connected to the housing 172. The light source 168 projects light and the light filter 174 defines lines that define the area for an activity, such as playing a game. The connector 160 connects the housing 172 to a structure (e.g., post or pole 104) used in or near the activity or game.

The light source 168 can be any form of illumination whether currently known or developed in the future, such as an incandescent bulb, gas bulb, light emitting diode (LED), etc. Multiple lighting elements (and a mixture of different types of lighting elements) can be used, depending upon illumination and power requirements. Further, the light source 168 can be an illuminating element that makes a pattern on its own, such as one or more lasers, which can (through rapid movement of the light beam) create a programmed desired image, eliminating the need for a light filter 174 or lens 164.

The apparatus 100 can also include one or more lenses 164 that are operatively connected to (directly or indirectly connected to) the housing 172. The lenses 164 focus the lines on the surface 106 where the activity or game occurs and can focus the light on other structures (such as the backboard, as discussed above). As noted above, the lines define areas where specific portions of the activity or game are to occur. The light source 168 projects the lines (through the filter 174) on the surface 106 that is otherwise without such lines used in the activity or game, such as a uniformly colored, non-lined area of flooring, asphalt, grass, or ground. This allows the activity or game to be played at night in an area that is not pre-lined for such an activity.

The apparatus 100 can include a self-contained power source 162 positioned within the housing 172 or a power unit 162 connected to an external power source through a power connection 170, as well as a non-transitory computerized device/memory 166 capable of storing and displaying multiple images. The self-contained power source or the power unit 162 is operatively connected to the light source 168 and powers the light source 168.

Figure 8:
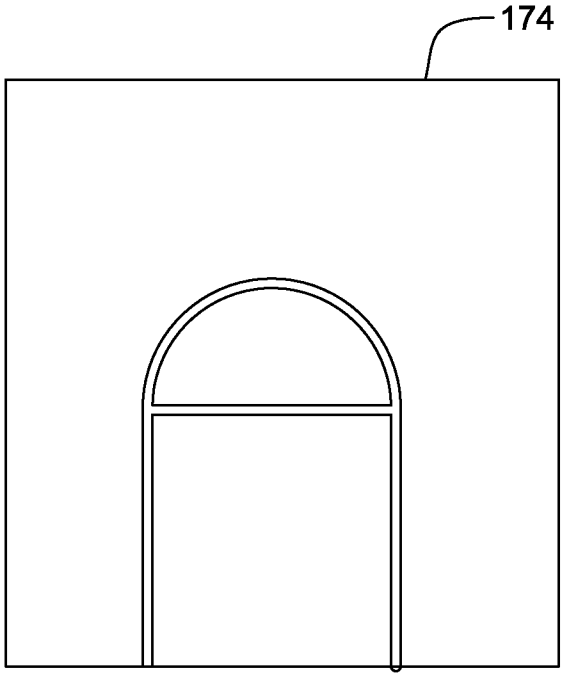
FIG. 8 is a side-view schematic diagram of a device according to embodiments herein.

The light filter 174 is optional because the light source 168 can comprise a digital projector, eliminating the need for any light filter. Some advantages of using a light filter in place of a digital projector include the reduced costs and reduce power consumption associated with a simple light source and light filter. An example of the light filter 174 is shown in FIG. 8. In its simplest form, the light filter 174 is a negative (or positive) image of the desired lines that are to be projected (in this case a basketball court foul lane using dark lines).

Figure 9:
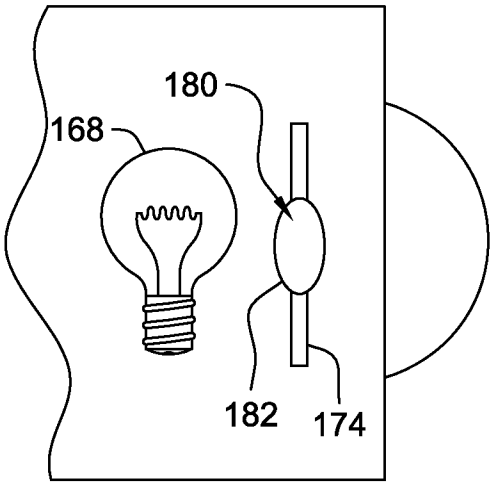
FIG. 9 is a side-view schematic diagram of a device according to embodiments herein.

FIG. 9 illustrates a portion of a apparatus 100 shown in FIG. 7 and is used to demonstrate that the embodiments herein can optionally include a rotational adjustment for the light filter 174 in order to compensate for optical image distortions that may occur due to the misalignment between the apparatus 100 and the activity surface 106. More specifically, as shown in FIG. 9, the light filter 174 can be mounted on an axis 180 which can be adjusted with an adjustment knob 182. Therefore, once a user has mounted the apparatus 100 on a pole 104 (or other structure) and has turned the light source 168 on, you can just adjust the adjustment knob 182 to properly align the lines being projected.

Computerized devices 166 are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A lighting system for use in combination with a basketball backboard device mounted on a pole, said lighting system comprising:

a plurality of lighting devices positioned adjacent said basketball backboard device said lighting devices comprising:

a housing;

a connector connected to said housing;

a first light source within said housing, a lens and a light filter operatively connected to said housing, said lens focusing lines defined by said light filter on an activity surface, said first light source being positioned to project said lines on to said activity surface, said lines defining a foul lane for a basketball court, said connector connecting said housing to said pole supporting said basketball backboard device; and a secondary light source on said housing, said secondary light source being positioned to simultaneously illuminate a backboard of said basketball backboard device while said first light source proiects said lines through said lens and said light filter, and said lines from said first light source combining together on said activity surface to the define an area for a basketball game.

2. The system according to claim 1, said lighting devices further comprising one of:

a self-contained power source positioned within said housing, said self-contained power source being operatively connected to said light source and powering said light source; and a power unit connected to an external power source, said power unit being operatively connected to said light source and powering said light source.

3. The system according to claim 1, said first light source projecting said lines on a portion of said activity surface that is otherwise without lines used in said activity.

4. The system according to claim 1, said lines defining areas where specific portions of said basketball game are to occur.

* * * * *